United States Patent [19]

Ohashi et al.

[11] 4,104,347

[45] Aug. 1, 1978

[54] METHOD OF MAKING A SAND MOLD

[75] Inventors: Yoshinobu Ohashi, Nishinomiya; Shizuo Inoue, Amagasaki, both of Japan

[73] Assignee: Kubota, Ltd., Osaka, Japan

[21] Appl. No.: 632,720

[22] Filed: Nov. 17, 1975

[30] Foreign Application Priority Data

| | | | |
|---|---|---|---|
| Nov. 19, 1974 | [JP] | Japan | 49-134772 |
| Nov. 19, 1974 | [JP] | Japan | 49-142294[U] |
| Feb. 18, 1975 | [JP] | Japan | 50-20596 |

[51] Int. Cl.[2] ..... C04B 35/14

[52] U.S. Cl. ..... 264/113; 264/118; 264/162; 264/219; 164/17

[58] Field of Search ..... 264/118, 162, 220, 219, 264/113; 164/17; 74/813

[56] References Cited

U.S. PATENT DOCUMENTS

| | | | |
|---|---|---|---|
| 1,206,553 | 11/1916 | Lewis | 264/118 |
| 3,101,516 | 8/1963 | Hokkeling | 164/17 |
| 3,387,645 | 6/1968 | Van Beckhoven | 164/17 |

*Primary Examiner*—Robert F. White
*Assistant Examiner*—James R. Hall

[57] ABSTRACT

A method of making a mold by the use of sand is started by filling a mass of sand in a mold jacket which is in turn rammed to provide a block of sand. The sand block thus formed is excavated by a cutting device to form a mold cavity. The cutting device is guided by a profiling machine in accordance with a predetermined program which describes the shape of an ultimately desired casting to be manufactured by the use of the sand mold.

1 Claim, 15 Drawing Figures

METHOD OF MAKING A SAND MOLD

The present invention relates in general to the art of making a mold and, more particularly, to a method of manufacturing a mold by the use of sand.

A casting mold prepared from sand, such as green sand, which is referred to as a sand mold, is nowadays largely employed in making a casting with cast iron or cast steel. Depending upon the design of the sand mold, it may be used in casting articles not only with metallic material other than cast iron or cast steel, but with plastic material or synthetic resin.

In any event, so far as metal casting is concerned, two methods have generally been employed to make the sand mold. One of these methods is practised by the use of a master pattern which is a replica of a desired casting. The master pattern may be either composed of a pair of pattern halves or of a one-piece construction. In the case where the master pattern is composed of a pair of pattern halves, either of the pattern halves is supported in a flask, which flask is subsequently filled with sand. After the sand has been hardened and when the pattern half is removed from the flask with the sand therein, there is left a mold half having a mold cavity corresponding in shape and size to that of the associated pattern half.

In the case where the master pattern is a one-piece construction, (although the application of the sand mold of one-piece construction is limited in practice,) the master pattern is supported in a flask, which flask is subsequently filled with sand so as to envelop said master pattern. After the sand has been hardened, the master pattern is removed from the sand surrounding said master pattern to provide a complete sand mold of one-piece construction or, alternatively, the hardened sand surrounding the master pattern is broken into two pieces, with due care, to provide corresponding mold halves.

The other of the methods is practised by the use of the master pattern, which master pattern is, prior to the sand in a flask being hardened, placed on the sand while an unnecessary portion of the sand is dragged out of the flask. After the sand has been hardened, there is left a sand mold having a mold cavity corresponding in shape and size to that of the master pattern.

These two methods have common features in that the master pattern, either being a one-piece construction or being composed of a pair of mold halves, is utilized and in that sand is applied to the outermost surface of the master pattern prior to said sand being completely hardened and have, therefore, such common disadvantages and inconveniences as set forth below.

(1) In view of the necessity of the master pattern, a relatively large amount of labor and cost is required in making the master pattern and, moreover, the maintenance of the master pattern for subsequent use requires a relatively large space for storage. This is quite considerable where production of castings or articles of different types and/or configurations in a relatively small quantity is desired, because master patterns must be kept in a number equal to the number of the types and/or configurations of the castings or articles to be manufactured. Where the master pattern or patterns are of a relatively large size, more difficulty will be encountered in the manufacture and maintenance thereof. Furthermore, in addition to the recent trend that skilled workers are not readily available, manufacture of the pattern or patterns requires a relatively great number of such skilled workers.

(2) Although automation can relatively easily be achieved in the manufacture of sand molds by the use of the master pattern where mass-production of small-sized or medium-sized castings or articles with the use of such sand molds is intended, manufacture of sand molds to be used in production of castings or articles of relatively large size or of castings or articles of different types and/or configuration in a relatively small quantity can hardly be automated and, therefore, still requires the skilled workers who are not readily available. Irrespective of the availability of the skilled workers, since the automation is difficult, the manufacture of the sand molds to be used in production of castings or articles of relatively large size or of castings or articles of different types and/or configurations in a relatively small quantity does not give a high yield and is not, therefore, profitable.

(3) Especially where the second mentioned method is employed wherein a larger number of workers are required than in the practice of the first mentioned method, the work environment tends to become so offensive that an insufficient labor force is available.

(4) In view of the fact that the application of the sand must be completed before the sand is completely hardened if the sand employed is a self-hardening type, relatively complicated care must be taken during the manufacture of the sand mold in such a way as to adjust the time required for the self-hardening sand to be manipulated in relation to the time for the same sand to become completely hardened and vice versa.

Furthermore, where the sand mold includes a core or mandrel which may be prepared from the same or a different sand, the sand mold and the core or mandrel have heretofore been manufactured at separate places with the use of separate instruments and equipment. Not only does the manufacture of the sand mold including the core or mandrel involve disadvantages and inconveniences similar to that described hereinabove, but also the necessity of the two separate facilities appears neither economical nor reasonable and has, in fact, results in an increased manufacturing cost which in turn affects the price of cast articles manufactured by the use of such a sand mold including such core or mandrel.

Accordingly, the present invention has for its essential object to provide an improved method of making a casting mold for the manufacture of castings or articles, which can be automatically performed by the use of any known program-controlled or digital-controlled profiling machine, thereby substantially eliminating the disadvantages and inconveniences inherent in the prior art methods.

Another important object of the present invention is to provide an improved mold making method wherein a mold cavity in a block of sand filled in a flask is formed by a cutting device operatively coupled to the profiling machine.

A further object of the present invention is to provide an improved mold making method which is suited for the production of relatively bulky castings or articles of different types and/or configurations in a relatively small quantity.

A still further object of the present invention is to provide an improved mold making method wherein formation of the mold cavity in the sand block is carried out when the sand, during the process of hardening, attains a predetermined hardness in terms of the compressive strength.

A still further object of the present invention is to provide an improved mold making method which may be practised without the use of a master pattern and does not substantially result in an offensive workshop environment.

According to the present invention, a mold making method is provided in which a mold cavity of a shape corresponding to the shape of a desired casting or article and into which a molten material, either metallic or synthetic resinous, is poured to form said casting or article, is formed by excavating a block of sand, filled in a flask, by means of a cutting device to which the present invention also pertains. The cutting device which is herein disclosed is operatively coupled to any known profiling machine so that said rotary grinder follows a predetermined path of movement corresponding to the contour of the desired casting. The predetermined path along which the cutting device moves while it performs an excavating operation is determined by a program set in the profiling machine, which program describes the design particulars of the desired casting. Alternatively, it may be determined by a live or miniature pattern set in the profiling machine. Whether the program and the live or miniature pattern is employed depends on the type of profiling machine to be used.

The excavation is carried out when the sand block being hardened in the flask attains a predetermined hardness in terms of the compressive strength which is within the range of 2 to 10 kg/cm$^2$, preferably 2 to 5 kg/cm$^2$. Assuming that the resistance imparted by the sand block of 5 kg/cm$^2$ compressive strength to the cutting device being operated to excavate said sand block is 1, a series of experiments conducted by the present inventors have shown that a sand block of 9 kg/cm$^2$ compressive strength gives a resistance of 2.5 to the cutting device during the excavating operation. This means that, if the resistance imparted from the sand block being excavated to the cutting device is high, the cutting device must have a correspondingly high horsepower which in turn results in a high power consumption. Therefore, although the excavation can be satisfactorily performed with the cutting device of the present invention even when the compressive strength of the sand block at the time of such excavation is within the range of 2 to 10 kg/cm$^2$, the range of 2 to 5 kg/cm$^2$ is preferred.

The mold making method according to the present invention also has the advantage that, where the sand mold having a core or mandrel is to be manufactured, only a single production line is required. In other words, the mold and the core need not be manufactured separately and the core can be manufactured during the course of production of the complete sand mold.

The cutting device for carrying out the method according to the present invention comprises at least one blade assembly of substantially inverted T-shape and a support structure which carries the blade assembly mounted on one end thereof and has the other end rigidly connected to a movable frame forming a part of, or otherwise operatively associated with, a conventional profiling machine. Alternatively, the support structure may be a movable arm of a profiling machine which is driven in accordance with the program or the live or miniature pattern set in the profiling machine.

Furthermore, the blade assembly may have formed therein a passage means through which a cementing liquid, or some other hardening agent, is supplied onto the skin of the sand block being excavated or through which scraps of sand excavated from the skin of the sand block are ejected under suction from the recess which ultimately forms the mold cavity. Alternatively, the blade assembly may have passage means both for the supply of the cementing liquid or hardening agent and for the ejection of the sand scraps.

These and other objects and features of the present invention will readily become apparent from the following description taken in conjunction with preferred embodiments thereof with reference to the accompanying drawings, in which:

FIGS. 1(A)–1(L) constitute a diagrammatical flow chart of the mold making process according to the present invention;

Figure 1:
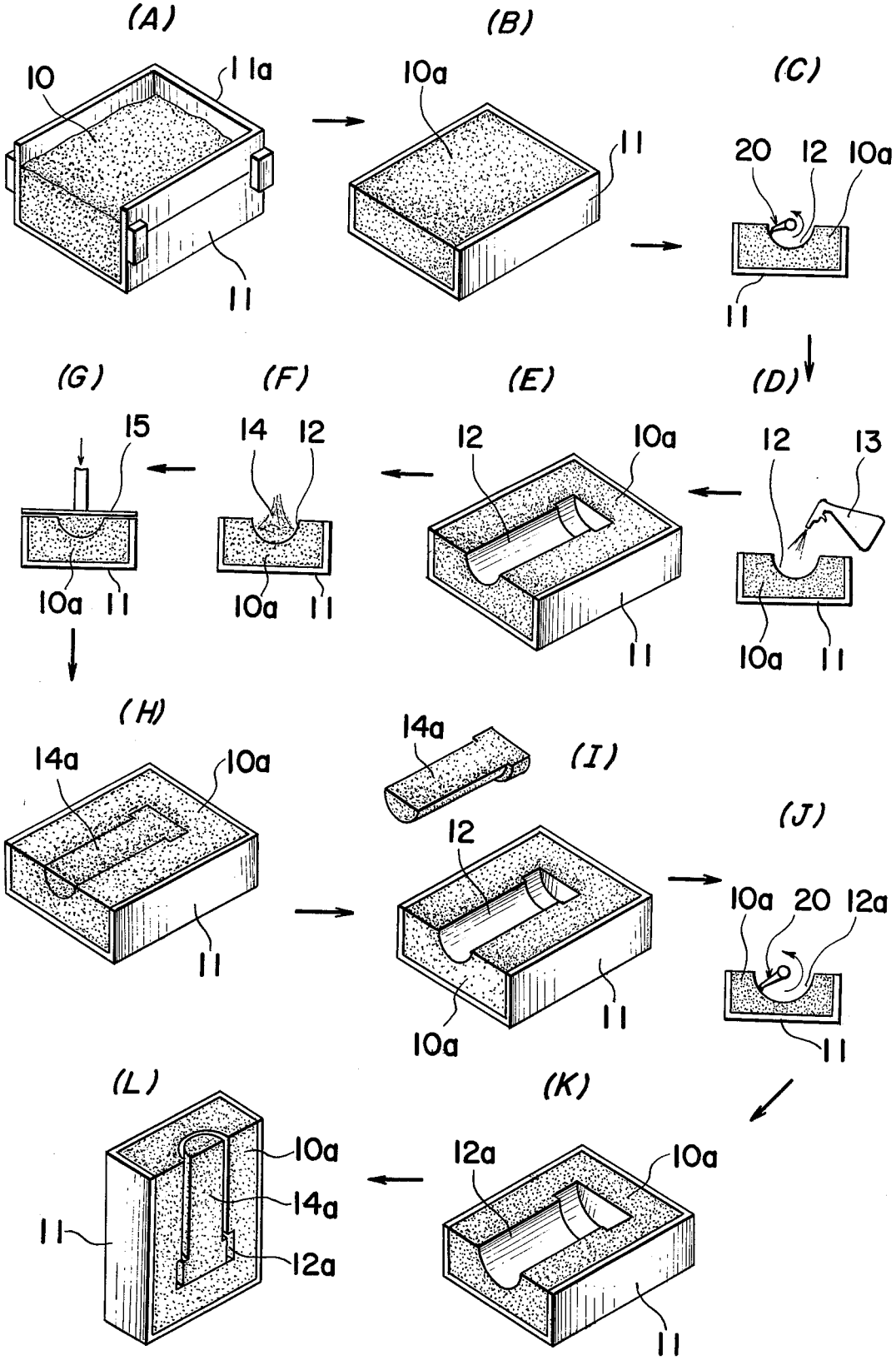

It is to be noted that, in the description of the method according to the present invention which will proceed with particular reference to FIGS. 1(A)–1(L), an example of making a sand mold assembly utilizable in the manufacture of a desired casting in the form of either a solid cylinder having one end enlarged in diameter or a cylindrical piping element having one end formed with a radially outwardly enlarged collar for connection with another cylindrical piping element is illustrated for the purpose of description of the present invention. It is also to be noted that, so far as the illustrated and described example referred to above is concerned, the sand mold assembly should be composed of a pair of mold units or halves of the same construction, although this is not always true for reasons which will become clear later. However, for the sake of brevity, only one of the mold units or halves of the entire mold assembly is illustrated throughout the accompanying drawings.

Referring now to FIGS. 1(A)–1(E), the steps shown are required for making one of the mold units or halves utilizable in the manufacture of a solid cylinder having one end enlarged in diameter while steps shown in FIGS. 1(A)–1(L) are required for making one of the mold units or halves utilizable in the manufacture of a cylindrical piping element having one end formed with a radially outwardly enlarged collar. This is particularly, but not exclusively, applicable if the shape and size of the solid cylinder is the same as or similar to that of the interior hollow of the cylindrical piping element.

As shown in FIG. 1(A), a self-hardening mixture 10, for example, any known mixture of sand and binder, is first filled into a substantially box-like flask or mold jacket 11, one of the side walls of said mold jacket 11 being omitted to show how the mold cavity is formed therein. As is well understood by those skilled in the art, at the time of filling of the mixture 10 into the mold jacket 11, the mixture 10 is so bulky that an enclosure 11*a* is required to prevent a portion of the mixture 10 above the level of the opening of the mold jacket 11 from overflowing out of the mold jacket 11. The enclosure 11*a* need not be always necessary if the mold jacket 11 has a sufficient depth.

The mixture 10 in the mold jacket 11 is subsequently rammed by any suitable method such as ramming to provide a pressed and formed block of mixture 10*a* as shown in FIG. 1(B). In the case where the enclosure 11*a* is employed, it may be removed from the top of the mold jacket 11 after the block 10*a* has been formed. The rammed block 10*a* in the mold jacket 11 is thereafter left to cure until the compressive strength thereof attains a predetermined value within the range of 2 to 10 kg/cm$^2$, preferably within the range of 2 to 5 kg/cm$^2$.

The next step is, as shown in FIG. 1(C), to subject the substantially half-cured block 11*a* to an excavating operation performed by a cutting device generally indicated by 20. The details of the cutting device 20 and that of a method of excavation performed thereby will be described later. However, it is to be noted that only one pass of the cutting device 20 relative to the block 10*a* in a direction of excavation is sufficient to form a core molding cavity or mold chamber 12. Alternatively, depending upon the type of profiling machine to be used in association with the cutting device 20, the cutting device 20 may repeatedly be passed over the block 10*a* until the mold chamber 12 of a desired or required size is subsequently formed in the block 10*a*, in which case the cutting device 20 must be moved closer to the block 10*a* in stepwise fashion at the beginning of each of the passes.

The shaped wall surface of the block 10*a* which defines the mold chamber 12 corresponding in shape to the shape of one of longitudinal halves of the desired casting, i.e., the solid cylinder, then has applied thereto a coating of parting agent. Application of the parting agent may be effected in any known and suitable method such as by means of a spray gun 13 shown in FIG. 1(D).

In the case where the desired mold assembly does not include any core or mandrel and is to be used in the manufacture of, for example, the solid cylinder described above, the parting agent spraying process such as shown in FIG. 1(D) may be omitted. In such case, when the mold unit wherein the shaped wall surface of the mold chamber 12 is not coated with the coating of the parting agent is clamped together with the other mold unit of the same construction with the mold chamber 12 in one mold unit aligned with that in the other mold unit, the complete mold assembly is obtained in readiness for manufacture of the solid cylinder.

On the other hand, in the case where the mold assembly for the casting of, for example, the cylindrical piping element described above, is desired and, therefore, includes a core which ultimately defines the hollow of the cylindrical piping element, the assembly shown in FIG. 1(E), which has just been subjected to the spraying process of FIG. 1(D), is subjected to is a step wherein, as shown in FIG. 1(F), a mass of mixture, which may be of the same composition as the mixture 10, is filled into the mold chamber 12 in the mixture block 10*a* as indicated by 14. The mixture 14, filled into the mold chamber 12, is subsequently rammed, as shown in FIG. 1(G), by the use of a ramming plate 15 or any other suitable ramming instrument to provide a block of mixture 14*a* accommodated within the mold chamber 12 in the block 10*a* as shown in FIG. 1(H). It is to be noted that the block 14*a* contacts the shaped wall surface of the mold chamber 12 in the block 10*a* through the coating of the parting agent applied thereto during the step shown in FIG. 1(D) and has a the shape and size corresponding to that of the longitudinal halves of the hollow of the cylindrical piping element which is ultimately desired.

The rammed block 14*a*, which is ultimately used as one of the longitudinal halves of the core in the mold assembly and which is still accommodated within the mold chamber 12 as shown in FIG. 1(H), is subsequently removed from the block 10*a*, separating from the shaped wall surface of the mold chamber 12. The separation of the rammed block 14*a* from the wall surface of the block 10*a* can be facilitated by the presence of the coating of the parting agent described above. The block 14*a*, which now forms one of the halves of the core after having been removed from the block 10*a*, is temporarily retained on one hand and the block 10*a* from which the block 14*a* has already been removed is again subjected to a similar excavating operation as shown in FIG. 1(J) on the other hand.

The excavating step of FIG. 1(J) is substantially identical with that of FIG. 1(C), but during the excavating step of FIG. 1(J), however, the cutting device 20 is operated so as to excavate the shaped wall surface of the mold chamber 12 an additional depth corresponding, or substantially equal, to the wall thickness of the desired cylindrical piping element, that is, the difference between the outer and inner diameters of said cylindrical piping element to form a part molding cavity or mold chamber 12*a*.

As will become clear later, the cutting device comprises at least one rotary blade assembly of substantially inverted T-shape having a stem and a cutter element extending substantially at right angle to the stem, said stem having one end rigidly, or otherwise integrally, connected with said cutter element and the other end rotatably and detachably supported by the support structure. Therefore, it is clear that, in order for the same cutting device 20 to be used in excavating mold chambers of different radii of curvature, it is necessary to replace one blade assembly with another blade assembly wherein the length of the stem is different from, for example, greater than, that of said one blade assembly. More particularly, the length of the stem of the blade assembly used during the step of FIG. 1(C) is less than that of the blade assembly used during the step of FIG. 1(J) by an amount corresponding to the thickness of the wall of the desired cylindrical piping element.

In practice, the replacement of one blade assembly with another blade assembly may be considered undesirable or complicated. In order to avoid this, according to the present invention, the stem of the blade assembly is made adjustable in length as will be described in more detail with reference to FIG. 4.

Referring still to the parts of FIG. 1, as shown in FIG. 1(K), the block 10*a* having the mold chamber 12*a* of greater radius of curvature than that of the mold chamber 12 is obtained after the excavation step of FIG. 1(J) has been completed. The assembly shown in FIG. 1(K) is subsequently allowed to stand until the block 12*a* attains the final maximum compressive strength which is substantially higher than the compressive strength of the block 10*a* at the time the step of FIG. 1(C) has started and, more particularly, during the period from the step of FIG. 1(C) to the step of FIG. 1(J). It is to be noted that, by the time the block 10*a* in the assembly of FIG. 1(K) has been cured to the final maximum compressive strength, the block 14*a* for the core half which has been temporarily retained as hereinbefore described has also been cured to its final maximum compressive strength.

Thereafter, as shown in FIG. 1(L), the block 14*a* for the core half is placed within the mold chamber 12*a* in the assembly of FIG. 1(K) and in alignment with said mold chamber 12*a*. In order to avoid any possible displacement of the block 14*a* for the core half within the mold chamber 12*a* which is now defined to represent the shape and size corresponding to that of one of the longitudinal halves of the desired cylindrical piping element to be cast, one or both ends of the block 14*a* for the core half may be cemented to the block 10*a* in the position as shown in FIG. 1(L) by the use of any suitable bonding agent.

It is clear that the complete mold assembly for the casting of the desired cylindrical piping element can be obtained by clamping, or otherwise combining in any suitable manner, one mold unit of the construction shown in FIG. 1(L) together with another mold unit of the same construction with the core halves 14*a* forming a solid cylinder corresponding in shape and size to that of the interior of the desired cylindrical piping element.

In the foregoing description, it has been described that the excavation operation is first performed when the compressive strength of the block 10*a* being cured has attained a value within the range of 2 to 10 kg/cm$^2$. This is particularly applicable where the particle size of the sand used is within the range of 200 to 400 microns (or Nos. 6 to 7 according to the Japanese Industrial-Standards) and, in such a case, a smooth wall surface can be obtained in the mold chamber without any additional finishing process being required.

As an example of the mixture 10, it may be a mixture of silica sand, approximately 300 microns in particle size, with sodium silicate in an amount of 7% and sodium chlorate in an amount of 2.7%. Where the mixture of the previously described composition is employed, it has been found that the excavation operation can be performed thereon about 24 hours after it has been kneaded and filled in the mold jacket. It has also been found that the mixture of the previously described composition can have a compressive strength of approximately 20 kg/cm$^2$ at the time it has completed its curing process.

It has also been found that even a mixture containing a modified Portland cement, "Jet Cement" (trademark owned by Onoda Cement Mfg. Co.), in an amount of 8% relative to the total weight of the sand can have a compressive strength of approximately 20 kg/cm$^2$ at the time it has completed its curing process.

In the manufacture of the mold according to the present invention, sand having no self-hardening or curing property may be employed. In this case, it may be necessary to apply a cementing liquid, or a liquid bonding agent, onto the shaped wall surface of the mold chamber. With the cutting device according to the present invention, application of the cementing liquid on to the shaped wall surface of the mold chamber 12 and/or 12*a* can be effected simultaneously with the excavation operation and, to this end, as will become clear from the subsequent description, the blade assembly of the cutting device has formed therein a passage means for supply of the cementing liquid.

In the foregoing description, the mold has been described as composed of a pair of mold halves and reference to one of them has been made. However, it can readily be understood by those skilled in the art that, depending upon the shape and type of the desired casting to be cast, a single mold may suffice.

It is further to be noted that, during the step of FIG. 1(G), the ramming plate 15 may repeatedly be driven by the application of high pressure by means of, for example, a fluid-operated cylinder or ram (not shown), to tightly ram the mixture 14 into the mold chamber 12.

Figure 2:
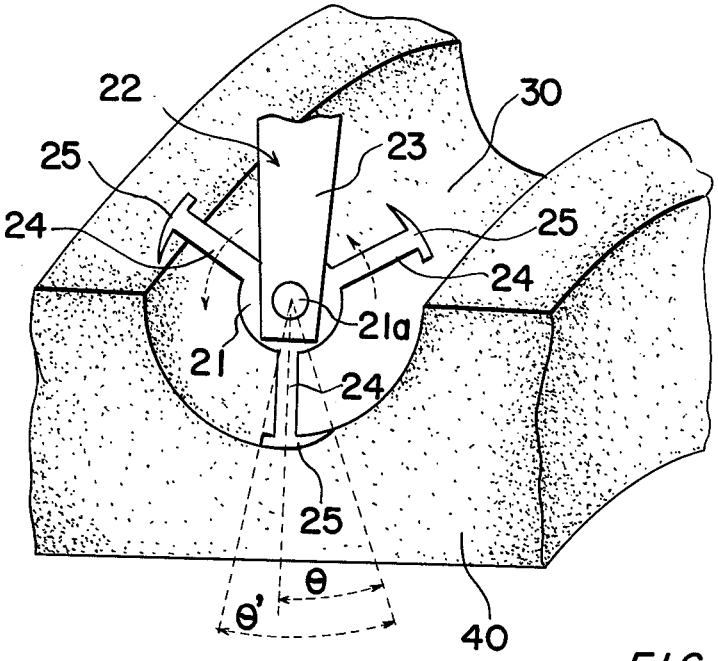
FIG. 2 is a schematic perspective view of a rotary cutting device according to the present invention.

Referring now to FIG. 2, the cutting device is shown as having three blade assemblies which are radially outwardly extending from a common hub 21 rotatably carried by the support structure 22 having a construction which will subsequently be described. It is also to be noted that, in FIG. 2, the cutting device 20 is shown as being operated to excavate a curved groove 30 of substantially semicircular cross section in a rammed block 40 (corresponding to the block 10*a* in FIG. 1), which curved groove 30 ultimately serves as a mold cavity into which molten material is poured during casting.

The support structure 22 includes a pair of retaining arms, only one of which is shown at 23 because of the other retaining arm is located behind said one retaining arm, said retaining arms vertically downwardly extending from the framework (not shown) which forms a part of, or are otherwise operatively associated with, any known profiling machine (not shown). As hereinbefore described, this support structure 22 is movable in accordance with the program or the live or miniature pattern set in the profiling machine.

At a lower end of the support structure 22 and between the arms 23, the hub 21 having a pair of opposed bosses 21*a* extending perpendicular to the plane of said hub 21 is rotatably mounted with said bosses 21*a* journalled in the respective arms 23.

Figure 3:
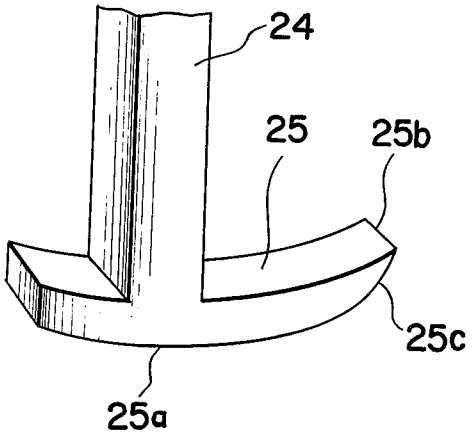
FIG. 3 is a perspective view, on an enlarged scale of one blade assembly employed in the rotary cutting device of FIG. 2.

Each of the blade assemblies includes a 24 and a cutter element 25. The stem 24 has one end rigidly connected to, or otherwise integrally formed with, the hub 21 and the other end rigidly connected to, or otherwise integrally formed with, the cutter element 25. As best shown in FIG. 3, the cutter element 25 is substantially in the form of an elongated bar of rectangular cross section and is designed such that at least one of the opposed faces of the body of said cutter element 25, which contacts the shaped wall surface of the mold chamber 30 during operation and which is remote from the connection between said cutter element and said stem 24, i.e., an outer face designated by 25*a*, is curved so as to have a curvature of a portion of the right circle the center of which is in alignment with the axis of rotation of the hub 21. The other of the faces of the body of the cutter element 25, i.e., an inner face to which the stem 24 is connected, may be straight or be correspondingly curved as shown.

Figure 4:
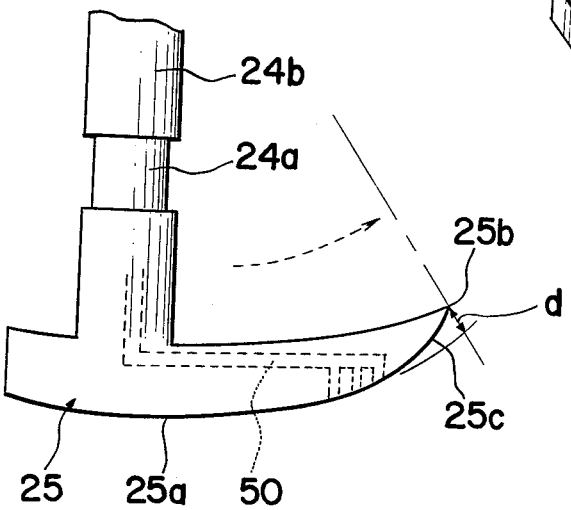
FIG. 4 is a side elevational view of a modified blade assembly.

One of the opposing ends of the cutter element 25, which is on the leading side with respect to the direction of rotation of the blade assembly as indicated by the arrow, is shaped to provide a blade 25*b* and, to this end, a portion of the outer face 25*a* adjacent the blade 25*b* is substantially radially inwardly acutely curved as shown at 25*c*, diverging from the right circle occupied by the outer face 25*a* of the body of the cutter element 25. It is to be noted that the distance *d* of divergence, which is defined as a distance from the tip of the blade 25*b* to the intersecting point between the imaginary line, which extends from the center of rotation through the tip of the blade 25*b*, and the imaginary right circle occupied by the outer face 25*a*, is preferably within the range of 1 to 5 mm, as shown in FIG. 4.

The length of the cutter element 25 is selected such that said cutter element 25 extends through an angle $\theta'$ of 10° to 15° while the portion of the cutter element between the tip of the blade 25*b* and the point at which the longitudinal axis of the stem 24 intersects the longitudinal axis of the body of the cutter element 25 extends through an angle $\theta$ of 5° to 10°.

While each of the cutter elements 25 of the respective blade assemblies is constructed as hereinbefore described, the stems 24 of these blade assemblies, which extend radially outwardly from the common hub 21, are preferably spaced an equal distance from each other around said hub 21.

During operation, the hub 21 is driven by a drive mechanism (not shown) which may be carried by the support structure 22 so that the blade assemblies are rotated in the direction shown by the arrow, thereby performing the excavating operation in the manner as hereinbefore described with particular reference to the parts of FIG. 1.

During the excavating operation, while the blade **25*b* of each of the cutter elements 25 acts to remove unnecessary sand to define the shaped wall surface of the mold chamber 30 in the block 40, the curved face 25*a* serves to tightly press the mixture, while held in frictional contact with a consecutive portion of the wall surface of the mold chamber 30, thereby to render the shaped wall surface of the mold chamber 30 substantially smooth. This is possible because, as hereinbefore described in connection with the distance of divergence, the blade 25*b* is positioned such that it diverges from the plane of the curved face 25*a*. In other words, the portion of the wal surface of the mold chamber 30 in the block 40, which frictionally contacts the outer face 25*a* of the cutter element 25** of each of the blade assemblies, is radially outwardly compressed a distance corresponding to the distance of divergence as defined above.

In the case where a hardening agent, such as a cementing liquid or a liquid adhesive material, is to be applied onto the shaped wall surface of the mold chamber 30, a liquid supply passage means may be formed in each of the cutter elements 25 as best shown in FIG. 4. In the example shown in FIG. 4, the liquid supply passage means, indicated by 50, extends within the body of the cutter element 25 and has one end opening at a portion of the curved outer face **25*a* adjacent the acutely curved face 25*c***.

So far as the blade assemblies shown in FIGS. 2 and 3 are concerned, it is preferable that the hub 21 be rotatably and detachably mounted on the support structure 22 for facilitating the replacement of one unit of the blade assemblies with another unit. Alternatively, each of the stems 24 of the respective blade assemblies may be made adjustable in length such as shown in FIG. 4 to which reference will now be made.

In FIG. 4, each of the cutter elements 25 is shown as having a stub **24*a* extending from the cutter element 25, which stub 24*a* is telescopically adjustably inserted into a stem portion 24*b* which extends from the hub 21 (FIG. 2). For avoiding any possible separation of the stub 24*a* and, therefore, the cutter element 25 from the stem portion 24*b*, a locking bolt (not shown) is adjustably provided in the stem portion 24*b***.

In the case where the distance $d$ of divergence, the angle $\theta$ and the angle $\theta'$ all associated with each of the blade assemblies having the construction shown in FIG. 4, depart from the respectively predetermined ranges when the associated cutter element 25 is radially outwardly extended from the stem portion **24*b***, replacement of one unit of the blade assemblies with another unit is recommended.

In the foregoing description, the passage means has been described as used to supply the hardening liquid. Alternatively, this passage means may be communicated to a source of vacuum (not shown) for removing under suction scraps of material cut from the block 40 to define the shaped wall surface of the mold chamber 30.

The cutting device having the construction as hereinbefore fully described is particularly applicable for making a mold cavity of substantially semi-circular cross section.

Although the present invention has been fully described in conjunction with the preferred embodiments thereof, it should be noted that various changes and modifications willbe apparent to those skilled in the art. For example, the cross sectional shape of the cutter element 25 need not always be limited to rectangular, but may be square or any other shape (not shown) if and only if the outer face **25*a*** is flat. In addition, both passage means for the supply of the hardening liquid and for the suction may be formed in each of the cutter elements (not shown).

Moreover, the hub 21, which has been described as having three blade assemblies, may have one, two or more than three blade assemblies (not shown). In addition, where the hub 21 has a plurality of stems, the cutter element need not be provided for each stem in which case, while one stem carries a blade assembly, another stem following said one stem with respect to the direction of rotation can carry a presser (not shown) which corresponds in function to the curved outer face **25*a***.

Furthermore, although the cutting device has been described as comprised of the rotary blade assemblies, it may be comprised simply of one or more cutting tools operatively carried by the profiling machine for linear movement (not shown). In this case the cutting tools need not have the sledgelike shape as described and shown and can be used for excavating a groove of substantially cornered cross section, for example, square or rectangular cross section.

Accordingly, such changes and modifications are to be understood as included within the true scope of the present invention unless they depart therefrom.

What is claimed is:

1. A method of making a sand mold having a part molding cavity and a core for casting an annular part between the portion defining said part molding cavity and said core, comprising:

(a) forming a mixture of sand having a particle size of 200–400 microns and a self-hardening binder therefor;

(b) placing a sufficient amount of said mixture in a mold jacket to fill said mold jacket;

(c) pressing and forming said mixture in said mold jacket into a block having at least one surface a portion of which is a substantially planar;

(d) relieving said block of said pressure;

(e) allowing said block to stand to permit said binder to partially cure to give said block a predetermined compressive strength of from 2–10 kg/cm$^2$ which is less than the ultimate compressive strength when said binder is fully cured;

(f) bringing into contact with said portion of said surface the cutter element of a rotating blade assembly to cut said block and moving the peripheral surface of said cutter element which trails, relative to the direction of movement of said blade assembly, the portion of the cutter element which carries out the cutting action along the surface exposed by the cutting for exerting a compressive force on the exposed surface;

(g) moving said blade assembly in a plane transverse to said block planar surface while said blade assembly continues cutting in said block a core molding cavity corresponding to the shape of a core for at least part of the part to be cast;

(h) applying a coating of a parting agent to the exposed surface of said core molding cavity;

(i) placing an additional amount of said mixture in said core molding cavity to fill said core molding cavity;

(j) pressing and forming said mixture in said core molding cavity into a core member corresponding to the shape of the core molding cavity;

(k) relieving said core member of said pressure;

(l) removing said core member from said core molding cavity;

(m) again carrying out the steps (f) and (g) for further cutting the exposed surface of said block in said core forming cavity to form in said block the part molding cavity; and (n) placing said core member in said part molding cavity as at least part of the core for the annular part prior to casting the annular part.

* * * * *